US009167927B2

(12) United States Patent
Byun

(10) Patent No.: US 9,167,927 B2
(45) Date of Patent: Oct. 27, 2015

(54) METHOD OF FORMING SIDE PAPER OF A FOLDABLE PAPER CUP, AND FOLDABLE PAPER CUP

(76) Inventor: Donghwan Byun, Seoul (KR)

( * ) Notice: Subject to any disclaimer, the term of this patent is extended or adjusted under 35 U.S.C. 154(b) by 125 days.

(21) Appl. No.: 13/876,214

(22) PCT Filed: Sep. 28, 2011

(86) PCT No.: PCT/KR2011/007114

§ 371 (c)(1),
(2), (4) Date: Mar. 27, 2013

(87) PCT Pub. No.: WO2012/044044

PCT Pub. Date: Apr. 5, 2012

(65) Prior Publication Data

US 2013/0193198 A1 Aug. 1, 2013

(30) Foreign Application Priority Data

Sep. 27, 2010 (KR) ..... 10-2010-0093382

(51) Int. Cl.
*B31B 1/00* (2006.01)
*A47G 19/22* (2006.01)
(Continued)

(52) U.S. Cl.
CPC ..... *A47G 19/2205* (2013.01); *B31B 5/14* (2013.01); *B31B 19/00* (2013.01); *B65D 3/06* (2013.01);
(Continued)

(58) Field of Classification Search
CPC .... B31B 1/00; B31B 2217/003; B31B 49/00; B31B 17/00; B31B 2217/0023; B31B 3/00; B31B 1/12; B31B 1/20; B31B 1/22; B31B 1/25; B31B 19/26; B31B 2201/2654; B31B 2217/082; B31B 2219/2672
See application file for complete search history.

(56) References Cited

U.S. PATENT DOCUMENTS 4,349,400 A * 9/1982 Gilden ..... 156/217
5,908,590 A * 6/1999 Yoshimi et al. ..... 264/45.4
(Continued)

FOREIGN PATENT DOCUMENTS

JP 55-053735 4/1980
JP 03-043429 4/1991
(Continued)

OTHER PUBLICATIONS

International Search Report for PCT/KR2011/007114 mailed May 7, 2012.

*Primary Examiner* — Sameh Tawfik
(74) *Attorney, Agent, or Firm* — AKC Patents, LLC; Aliki K. Collins

(57) ABSTRACT

The present invention relates to a paper cup, and more particularly, to a foldable paper cup in which a volume of a container is variable, and a method of manufacturing a side paper of the foldable paper cup. The method of manufacturing the side paper of the foldable paper cup includes: a first step of forming a cutting part for dividing a portion of a continuous side paper source paper into upper and lower portions of the side paper; a second step of providing a release part to which the side paper source paper and a film do not adhere on a portion of the upper portion of the side paper so as to laminate the film and the side paper source paper; a third step of cutting a film on one end of the release part and separating the side paper from the side paper source paper in a fan shape; and a fourth step of rolling up the side paper around a forming mechanism to form a container sidewall having a cone shape. A curling part is formed on the entire circumference of an upper end of the side paper of the foldable paper cup manufactured so that upper and lower portions of the container are separated so as to fold a boundary between the upper and lower portions. Here, a bottom paper support part, for supporting a bottom paper inserted into the entire circumference of the lower end of the side paper, is formed. Thus, in the method of manufacturing the foldable paper cup of the present invention, an additional process is performed prior to an existing manufacturing process to utilize the existing process of manufacturing the paper cup as-is. Also, since the manufacturing processes are simplified, additional costs required for manufacturing the foldable paper cup may be inexpensive. In the foldable paper cup of the present invention, the volume of a container of a cup ramen may be reduced to reduce distribution costs in stages of distribution. Also, the foldable paper cup may be easily portable. When the foldable paper cup is used, the foldable paper cup may provide a container having a large volume similar to that of the container of a conventional cup ramen and may also be firm.

17 Claims, 5 Drawing Sheets

(51) Int. Cl.

| | |
|---|---|
| ***B31B 19/00*** | (2006.01) |
| ***B65D 3/06*** | (2006.01) |
| ***B65D 3/22*** | (2006.01) |
| ***B65D 21/08*** | (2006.01) |
| ***B31B 5/14*** | (2006.01) |

(52) U.S. Cl.

CPC ..... *B65D 3/22* (2013.01); *B65D 21/086* (2013.01); *B31B 2201/2604* (2013.01); *B31B 2217/0007* (2013.01); *B31B 2217/062* (2013.01); *B31B 2217/082* (2013.01)

(56) References Cited

U.S. PATENT DOCUMENTS

| | | | | |
|---|---|---|---|---|
| 5,992,489 | A * | 11/1999 | Busse | 156/443 |
| 6,253,995 | B1 * | 7/2001 | Blok et al. | 229/403 |
| 7,100,770 | B2 * | 9/2006 | D'Amato | 206/505 |
| 2005/0227029 | A1 * | 10/2005 | Dart et al. | 428/36.5 |
| 2006/0005917 | A1 * | 1/2006 | Alvarez | 156/215 |
| 2006/0131316 | A1 * | 6/2006 | Bresler | 220/737 |
| 2006/0144915 | A1 * | 7/2006 | Sadlier | 229/403 |

FOREIGN PATENT DOCUMENTS

| | | |
|---|---|---|
| KR | 20-0248369 | 10/2001 |
| KR | 10-0533774 | 12/2005 |
| KR | 10-0738813 | 7/2007 |

* cited by examiner

METHOD OF FORMING SIDE PAPER OF A FOLDABLE PAPER CUP, AND FOLDABLE PAPER CUP

RELATED APPLICATIONS

This application is a 371 application of International Application No. PCT/KR2011/007114, filed Sep. 28, 2011, which in turn claims priority from Korean Patent Application No. 10-2010-0093382, filed Sep. 27, 2010, each of which is incorporated herein by reference in its entirety.

CROSS-REFERENCE TO RELATED APPLICATION

This application claims the benefit of Korean Patent Application No. 10-2010-0093382, filed on Sep. 27, 2010 in the Korean Intellectual Property Office, the disclosure of which is incorporated herein by reference.

TECHNICAL FIELD

The present invention relates to a paper cup, and more particularly, to a foldable paper cup that can vary a volume of a container.

BACKGROUND ART

A disposable paper cup is cheap and can be simply managed after use, and thus the disposable paper cup can be used in various fields. Particularly, the disposable paper cup is widely used as a cup ramen container.

A conventional cup ramen container is generally formed in a cone shape having a narrow bottom surface and includes a cone-shaped container side wall and a curling part circularly wound to the outside in an upper end portion of the side wall, and a bottom paper support shaping portion that is coupled to enclose the downward bent portion by bending a lower end portion of a side paper to the inside in a state in which a bottom paper having a downward bent portion in which an entire circumference of an outer circumferential surface is bent downward is inserted into the lower end portion of the side paper.

A dry ramen and soup are housed at the inside of the container and by covering an upper portion thereof with a lid, the container is sealed, and for waterproof and strength reinforcement, the inside of a paper cup is laminated. However, due to a capacity of hot water that pours in order to cook the ramen, the cup ramen container should have a capacity larger than that of contents. Due to a large volume of the cup ramen container thereof, a much cost is requested for distribution such as packing, storage, and transportation and while traveling, a quantity of cup ramen containers in which a consumer can carry is limited.

In order to solve such a problem, there have been various attempts for reducing a volume of a container. Korean Registered Utility Model No. 20-0271843 suggests a method of manufacturing a side wall of a container into wrinkles. The above invention appropriately performs a function of reducing a size of the container. However, when hot water is poured into the container, the invention is weak on a function of maintaining a height and a shape of the container in order to prevent hot water from flowing to the outside, and a paper is inappropriate when manufacturing the container in a wrinkle form, and plastic is appropriate when manufacturing the container in a wrinkle form but is an expensive material.

DISCLOSURE

Technical Problem

The present invention is made to overcome the above mentioned problems, and it is an object of the present invention to provide a method of manufacturing a side paper for easily manufacturing a foldable paper cup that can reduce a distribution cost by reducing a volume of a cup ramen container and in which a consumer can easily carry and that can fully perform a function as a container.

It is another object of the present invention to provide a method of cheaply manufacturing a foldable paper cup.

Technical Solution

To achieve the above objects, there is provided a method of shaping a side paper of a foldable paper cup of the present invention including first step of forming a cutting part 3 that divides a portion of a continued original side paper 1 into a side paper upper portion 6*a* and lower portion 6*b*, second step of laminating a film 2 and the original side paper 1 and forming a mold-releasing portion 4 in which the original side paper 1 and the film 2 are not bonded in a portion of the side paper upper portion 6*a*, third step of cutting (5) a film of an end portion of the mold-releasing portion 4 and separating a fan-shaped side paper 6 from the original side paper 1, and fourth step of forming a cone-shaped container side wall 9 by circularly winding the side paper 6 in a shaping device 20, as shown in FIG. 1, FIG. 2, FIG. 4 and FIG. 5.

A general paper cup is formed by circularly winding a fan-shaped side paper and bonding a round bottom paper. Therefore, in order to form a paper cup having a variable volume, variability of a side paper should be secured and thus in the present invention, an original side paper is cut into a portion to be a container upper portion and a portion to be a container lower portion. In this case, because a portion of the original side paper is cut as a cutting part, portions to be a container upper portion and a container lower portion in the original side paper are coupled to the continued original side paper by an uncut portion.

It is appropriate when the cutting part of the original side paper is a portion of ⅓-⅔ in a height direction of a foldable paper cup as a position that can lower a height of the foldable paper cup to the maximum while having no trouble in filling contents in the paper cup. When the foldable paper cup is packaged in a form in which a container upper portion encloses a container lower portion by moving the container upper portion toward the container lower portion, a height of the foldable paper cup of the present invention becomes ⅓-½, compared with a height of an integral paper cup. Therefore, a volume of the foldable paper cup is decreased to ⅓-½.

A laminating film intercepts a solution within the container from contacting with a side paper and performs a function of reinforcing strength of the side paper. Here, the film is a transparent or translucent thin film formed by extruding various resins, for example, a polypropylene (PP), polyethylene (PE), polyvinyl chloride (PVC), polystyrol (PS), polyamide (PA), polyethylene terephthalate (PET), or environment-friendly resin to a thickness of several μm to tens μms.

The container can vertically move by a mold-releasing portion in which the original side paper and the film do not bond, and the film positioned at here connects the separated side paper upper portion and lower portion and provides air-tightness that intercepts the inside and the outside of the container while maintaining the center when the container vertically moves.

In order to form the mold-releasing portion at an entire cylindrical surface of the container, one side of the side paper is separated with a method of not cutting an original side paper under the film and cutting only the film, and in order to circularly wind the side paper, a complete side paper is separated from the original side paper.

In a method of shaping a side paper of a foldable paper cup of a second invention, it is preferable that the first step further includes step of forming a side surface cutting part 3*a* that cuts in a height direction of the container by connecting to one end of the cutting part 3.

Thereby, in a process of separating a side paper of the third step from an original side paper, a portion 10*b* of an original paper of an internal bonding surface is cut away, and a film of the internal bonding surface is remained. Therefore, a film 10*b*2 of the internal bonding surface and a film 10*c*2 of the external bonding surface contact and are fusion-bonded by a heater block and thus the film is sealed in a circumferential direction, as shown in FIG. 6.

In a method of shaping a side paper of a foldable paper cup of a third invention, it is preferable that the first step further includes step of forming a plurality of cutting grooves 7 that cuts in a height direction of the container along the cutting part 3.

A cutting part divides the container upper portion and the container lower portion. Because radiuses of the container upper portion and the container lower portion are the same and the container upper portion and the container lower portion are securely supported by each other, the container cannot be folded. Therefore, in order to fold the container, a plurality of cutting grooves are formed with a method of increasing or decreasing a section of one side of the cutting part. The plurality of cutting grooves may be formed in a lower portion of the container upper portion or an upper end portion of the container lower portion, and by changing a radius of the cutting part, the plurality of cutting grooves enable the container upper portion to easily enclose the container lower portion and to easily move the container upper portion to the container lower portion.

In a method of shaping a side paper of a foldable paper cup of a fourth invention, it is preferable to further include step of applying and drying a mold-releasing agent to the mold-releasing portion 4 of an original side paper before or after the first step.

In conventional laminating, in a laminating process, it means deterioration or a failure of a quality that a mold-releasing portion occurs at a product surface. Therefore, in order to prevent a foreign substance from being attached to a surface in which a film and a printed material is bonded, a management process or a washing process is performed. However, in order to produce a paper cup according to the present invention, even after a laminating process of heating and pressing is performed, it is important to manage separation of portions that should not be bonded. Therefore, a mold-releasing agent having stability and a mold-releasing property in heating and pressing processes is preferable. For this processing, various mold-releasing agents are appropriate, but a mold-releasing agent of a silicone material is most appropriate.

In a method of shaping a side paper of a foldable paper cup of a fifth invention or a sixth invention, it is preferable that the film 2 of the second step is a laminating film in which an adhesive is applied to an entire film or the film or the original side paper is bonded by continuously applying an adhesive.

Laminating includes wet laminating that bonds a film and a printed material using an adhesive and dry laminating that fusion-bonds a film and a printed material by a heat. Dry laminating may use aqueous or oil chemicals between a film and a printed material. Here, a printed material and a film are fusion-bonded using a most general dry laminating method, a film heated by a mold, a roller, or a preheater has liquidity, and when the film is pressed by the mold or the roller, a liquid film is permeated into a micro groove in a surface of the printed material. In this state, when the film is cooled, the film and the printed material are fusion-bonded. Nowadays, a product of a roll state in which an adhesive is applied to a laminating film is available on the market.

In a method of shaping a side paper of a foldable paper cup of a seventh invention, it is preferable to apply the mold-releasing agent to an outer portion 10*b* of a side surface cutting part and an entire upper portion 4*a* of the side paper, except for an outer circumferential edge of an upper portion of the side paper, as shown in FIG. 3A.

It is preferable that a mold-releasing agent has a characteristic that is not bonded to an adhesive when contacting with the adhesive. Therefore, a combination of a hydrophobic or hydrophilic adhesive and a mold-releasing agent is required. Such a non-adhesive property may be a characteristic for a relatively short period of a few days.

For movement of an upper portion of the container, it is preferable that the mold-releasing portion has a wide range, and the mold-releasing portion includes an entire portion, except for a paper bonding portion 10*d* of the external bonding surface and a curling part 9*c* of the container upper portion and internal bonding surfaces 10*a* and 10*b*.

In a method of shaping a side paper of a foldable paper cup of an eighth invention, it is preferable that the film 2 of the second step is a laminating film in which an adhesive is applied to an entire film, except for the mold-releasing portion 4.

For partial laminating, partial laminating in which an adhesive is not partially applied to a laminating film may be performed. By laminating a film in which an adhesive is not applied to the mold-releasing portion, a mold-releasing agent may not be applied to the mold-releasing portion, and adhesive consumption can be reduced. In this method, a position of the film and an original side paper should be accurately set.

In a method of shaping a side paper of a foldable paper cup of a ninth invention, it is preferable to apply and dry a mold-releasing agent before or after the first step, a portion 4*b* pressed by a heater block at the fourth step in the mold-releasing portion 4.

In order to circularly wind and bond a side paper in a cone shape, a heater block is used. The side paper is bonded between a shaping mold and the heater block, an original paper bonding portion of the external bonding surface 10*d* and an original paper bonding portion of the internal bonding surface 10*a* are bonded, and a film bonding portion of the external bonding surface 10*c* and a film bonding portion of the internal bonding surface 10*b* are bonded. In this case, a film 10*a*2 of the internal bonding surface and an original paper 10*a*1 of the internal bonding surface should maintain a separated state, and the film 10*c*2 of the external bonding surface and an original paper 10*c*1 of the external bonding surface should maintain a separated state. A mold-releasing agent is applied to maintain a separated state, and an application region thereof is shown in FIG. 3B.

In a method of shaping a side paper of a foldable paper cup of a tenth invention, it is preferable that a shaping mold of a shaping machine has a pressing, high frequency, supersonic wave, or heater block at a portion at which a film bonding surface is positioned.

In a ninth invention, unlike a case of using a mold-releasing agent in order to maintain separation of a film from an original paper, a method of adding and fusion-bonding a pressing, supersonic wave, high frequency, or heater block within a shaping mold is used. Therefore, the original paper bonding portion is fusion-bonded by the pressing, supersonic wave, high frequency, or heater block installed at the outside, and the film bonding portion is fusion-bonded by the pressing, supersonic wave, high frequency, or heater block installed at the shaping mold.

In a method of shaping a side paper of a foldable paper cup of an eleventh invention, in the fourth invention or the eighth invention, it is preferable that the mold-releasing agent is a film or a thin plate of a material different from UV coating, silicone coating, or a laminating film.

In a method of shaping a side paper of a foldable paper cup of a twelfth invention, it is preferable that the third step simultaneously or sequentially performs a half knife work of cutting a film and an entire knife work of separating the side paper in a process.

In a method of shaping a side paper of a foldable paper cup of a thirteenth invention, it is preferable that the half knife work is a half knife work of a portion of a cutting part while cutting a film of one end of the mold-releasing portion.

In a method of shaping a side paper of a foldable paper cup of a fourteenth invention, it is preferable that the shaping device 20 of the fourth step includes a shaping mold 22, rotation plates 23 and 24, and a pressing, supersonic wave, high frequency, or heater block 21.

In a method of shaping a side paper of a foldable paper cup of a fifteenth invention, it is preferable that the shaping mold 22 has a cooling device at a portion at which a bonding surface is positioned.

In order to maintain a circular shape of the side paper by shaping, an original paper of an internal bonding surface of the side paper and an external film of the side paper are fusion-bonded by the heater block. In this case, in order to maintain separation of a film 10*a*2 of the internal bonding surface of the side paper at the inside from an original paper 10*a*1 of the internal bonding surface, a film surface is cooled not to be fusion-bonded by a heat of the heater block.

In a method of shaping a side paper of a foldable paper cup of a sixteenth invention, it is preferable that the rotation plates 23 and 24 operate internal bonding surfaces 10*a* and 10*b* of the side paper 6 to position at the inside further than external bonding surfaces 10*c* and 10*d*.

By enabling a rotation plate for bending the internal bonding surfaces 10*a* and 10*b* of the side paper 6 to move more quickly than a rotation plate for bending the external bonding surfaces 10*c* and 10*d* toward a shaping mold, the rotation plates may be sequentially overlapped.

In a foldable paper cup of a seventeenth invention, it is preferable that the foldable paper cup includes a cutting part 3 that divides a side paper into a side paper upper portion 6*a* and a side paper lower portion 6*b*; a mold-releasing portion 4 in which an original side paper 1 and a film 2 are not bonded in a portion of the side paper upper portion 6*a*, wherein the film 2 and the original side paper 1 are laminated, a film of an end portion of one side of the mold-releasing portion 4 is cut (5), and a side paper 6 is separated in a fan shape from the original side paper 1; a cone-shaped container side wall 9 that is formed by circularly winding the side paper 6 in a shaping device 20; a curling part 9*c* that is circularly wound to the outside in an upper end portion of the side wall; and a bottom paper support shaping portion 9*d* that is formed by coupling to enclose a downward bent portion by bending a lower end portion of the side paper to the inside in a state in which a bottom paper 11 having the downward bent portion in which an entire circumference of an outer circumferential surface is bent downward is inserted into a lower end portion of the side paper.

In a foldable paper cup of an eighteenth invention, it is preferable that a side paper upper portion 9*a* encloses a side paper lower portion 9*b*, the side paper upper portion 9*a* and the side paper lower portion 9*b* are overlapped, and the film 2 is folded inward of the container, as shown in FIG. 7.

It is preferable that a foldable paper cup of a nineteenth invention further includes a curling part that encloses to form space at an entire circumference of the outside of the container lower portion 9*b* and that advances inward in a lower end portion; and a paper outer cover 12 that is formed to move the container upper portion 9*a*, as shown in FIG. 8.

For insulation of a cup ramen container using hot water, a paper outer cover is used.

It is preferable that a foldable paper cup of a twentieth invention further includes a paper outer cover 13 in which a curling part that encloses to form space at an entire circumference of the outside of the container upper portion 6*a* and that advances inward of a lower end portion contacts with a lower end portion of the container upper portion.

For insulation of a cup ramen container using hot water, a paper outer cover is used.

It is preferable that in a foldable paper cup of a twenty first invention, display contents of a cup ramen container are printed at the bottom paper.

Advantageous Effects

In this way, according to the present invention, a method of manufacturing a side paper that can simply and cheaply produce the side paper of a foldable cup ramen container is provided.

Further, because an additional process is performed before an existing production process, an existing process of manufacturing a paper cup can be used, and the process is simple and thus a method of manufacturing a foldable paper cup in which an additional cost required when manufacturing a foldable paper cup is cheap is provided.

Further, by reducing a volume of a cup ramen container, a distribution cost can be reduced, and a consumer can easily carry the container, and when using the container, a secure foldable paper cup that may be formed in a large container like a conventional cup ramen container is provided.

BEST MODES FOR CARRYING OUT THE INVENTION

Hereinafter, exemplary embodiments of the present invention are described in detail with reference to the accompanying drawings.

In a general cup ramen paper container, a cone-shaped container side wall 9 in which a side paper is wound and a curling part 9*c* circularly wound at the outside in an upper end portion of the side wall are formed, and in a state in which a bottom paper 11 having a downward bent portion in which an entire circumference of an outer circumferential surface is bent downward is inserted into the inside of a lower end portion of the side paper, a bottom paper support shaping portion 9*d* by coupling to enclose the downward bent portion by bending a lower end portion of the side wall to the inside is formed.

Figure 1:
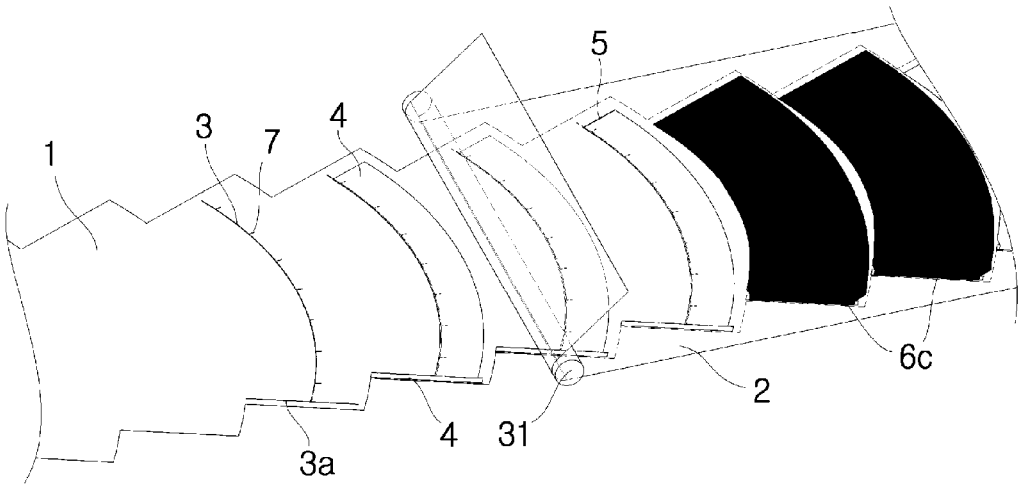
FIG. 1 is a schematic diagram illustrating a process of manufacturing a side paper of a foldable paper cup according to the present invention.

In the present invention, in order to reduce a volume of the container, by cutting an intermediate portion of a side paper with a method of adjusting a height of the container, a container height may be varied. FIG. 1 is a schematic diagram illustrating a process of manufacturing a side paper of a foldable paper cup according to the present invention and illustrates a process of manufacturing a continued original side paper to a variable side paper. Further, in FIG. 1, each process is continuously shown, but in actual process, each process is performed at a large gap and thus a length of a production line is longer extended than that is shown in FIG. 1.

A continued original side paper may be a generally used roll of paper, and in order to reduce an unused portion of the paper, the paper may be previously cut and used, as shown in FIG. 1. The continued original side paper passes through a Thomson device or a press device, and a cutting part, a side surface cutting part, and a cutting groove are cut by a cutting knife. A cutting part formed in the process is cut while forming a fan-shaped circular arc in an intermediate portion of a side paper, in one end portion thereof, a side surface cutting part that vertically meets with a circular arc is formed, and a plurality of fan-shaped cutting grooves vertically formed from the circular arc are formed.

A next process is a previous step of laminating and a mold-releasing agent is applied to the original side paper and the mold-releasing portion or an adhesive is applied to a laminating film (not shown).

As a method of applying a mold-releasing agent, by applying a mold-releasing agent to a surface of a roller and rotating the roller with the same speed as that of a continued original side paper, the mold-releasing agent is continuously applied to the original side paper. A shape of a portion that applies the mold-releasing agent may be formed in various shapes according to a pattern of unevenness formed on the surface of the roller.

When applying an adhesive to a film, by applying an adhesive to a surface of the roller and rotating the roller with the same speed as that of a continued film, the adhesive is continuously applied to the film. When applying an adhesive to an entire film, a cylindrical roller having no unevenness at the surface is used, and when partially applying an adhesive, an uneven pattern is formed at a surface of the roller.

An adhesive may not be applied to the film in a shape of a mold-releasing portion, and in this case, the adhesive is not applied to an original side paper and should accurately bond the film to the mold-releasing portion. Particularly, an adhesive application portion should not be bonded to a side paper upper portion by exceeding a cutting part and should not exceed a side surface cutting part.

In a next process, a half knife work that cuts away only an inverse L-shaped film portion to the outside along the cutting part and an end portion 5 of one side of the mold-releasing portion is performed. When the side paper is folded and the container is formed, a portion cut by this work enables the container upper portion and the container lower portion to move.

Figure 2:
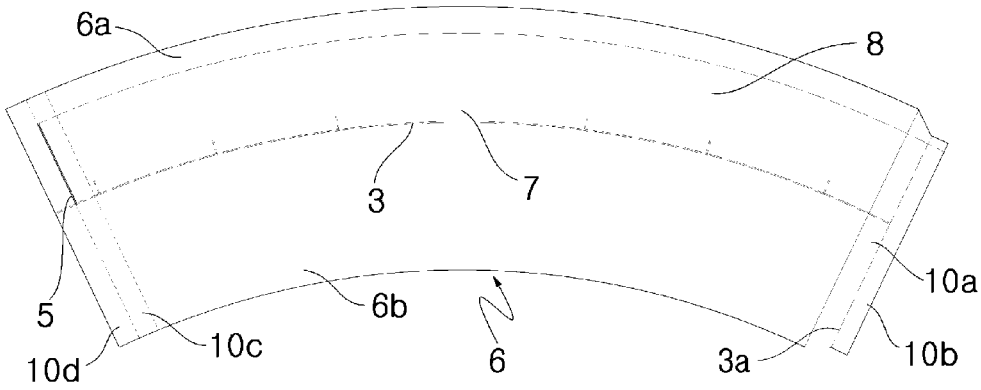
FIG. 2 illustrates a side paper of a foldable paper cup extracted in the process of FIG. 1.
Figure 3A:
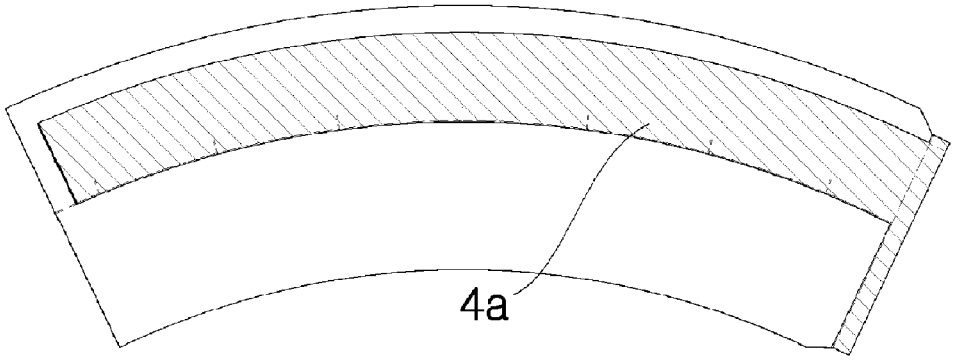
FIG. 3A illustrates a portion 4*a* in which a mold-releasing agent is applied to an original side paper, and a process of applying an adhesive to an entire film and laminating a continued side paper.
Figure 3B:
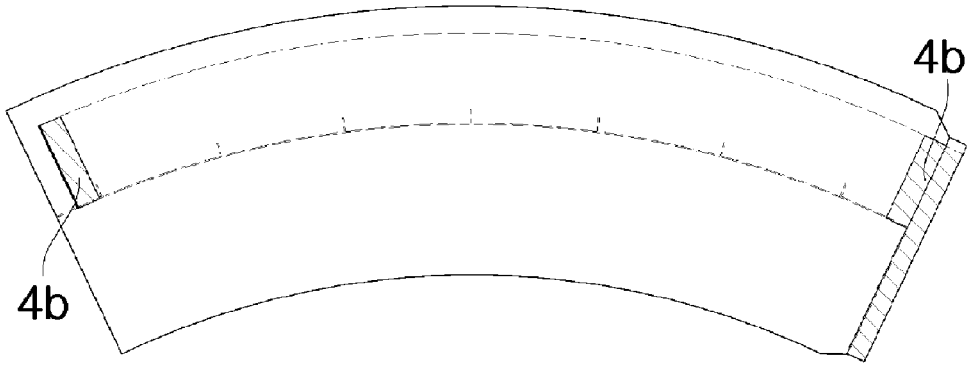
FIG. 3B illustrates a portion 4*b* in which a mold-releasing agent is applied to an original side paper, and a process of laminating in a state in which an adhesive is not applied to a portion contacting with a mold-releasing portion.
Figure 4:
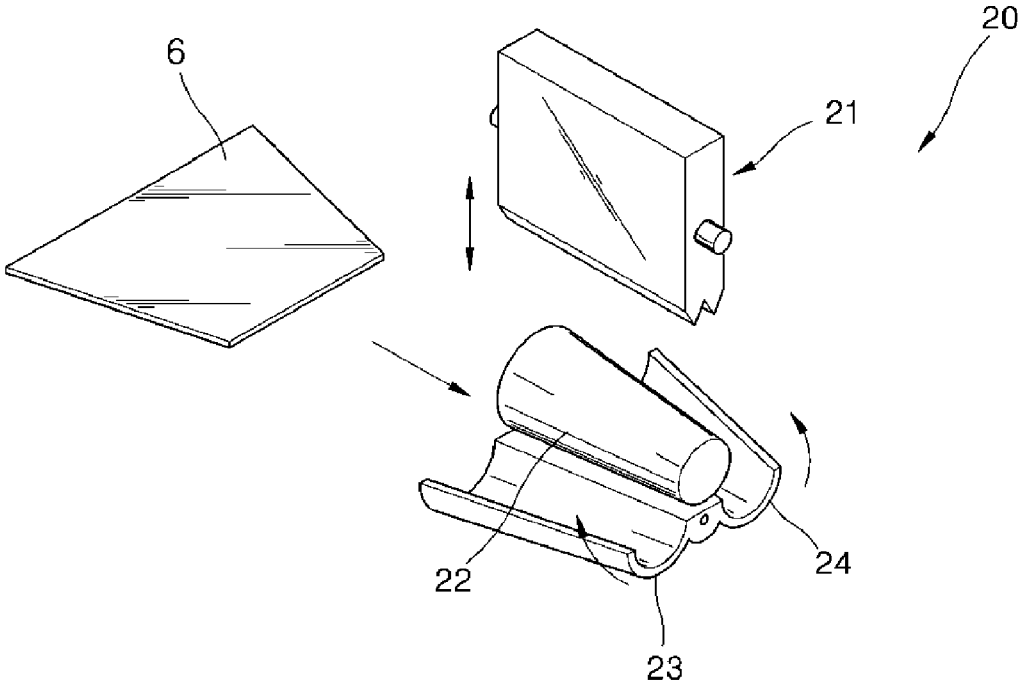
FIG. 4 is a schematic view of a side paper shaping unit for shaping the side paper of FIG. 2.

In a next process, the side paper is separated from a continued side paper in a way that separates a fan-shaped side paper shown in FIG. 2 from the continued side paper through a Thomson device or a press device. The separated side paper has a cutting part in an intermediate portion thereof and thus a side paper upper portion and a side paper lower portion have an unstable form connected only by a film. In order to prevent this case, it is preferable to cut the cutting part with some bonding portion left. The bonding portion enables to easily deliver and treat the side paper in a process, and when a foldable container is complete and is folded, the bonding portion is cut by some force and thus the foldable container may be easily folded.

In a next process, in order to circularly wind the side paper, the side paper is inserted into a side paper shaping device. In the side paper shaping device, a rotation plate is formed so that a cup-shaped shaping mold and the side paper continuously enter to one side and go out to the other side, and the rotation plate encloses a shaping mold at the outside.

Figure 5:
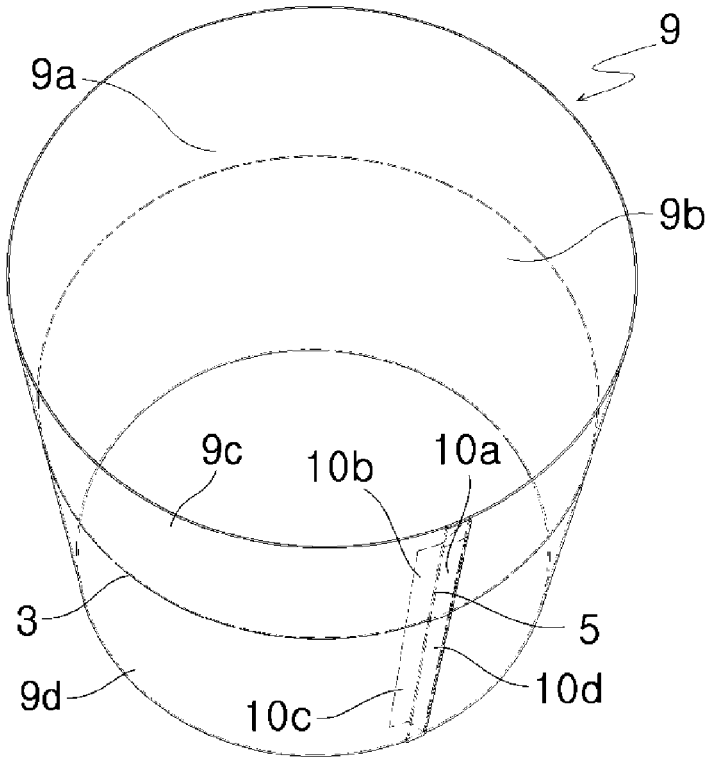
FIG. 5 is a perspective view of a side paper having a fusion-bonded bonding surface in the side paper shaping unit of FIG. 4.

The rotation plate encloses a shaping mold while rotating to both sides and encloses a side paper when the side paper enters, and the rotation plate rotates so that an internal bonding surface first contacts with the shaping mold and then the external bonding surface contacts with the shaping mold, and the rotation plate enables the side paper to contact with the shaping mold and presses bond surfaces of the side paper to be overlapped. In this state, when a supersonic wave block contacts with a bonding surface of the side paper, by injecting supersonic waves, the film is fusion-bonded, and the side paper forms a cone-shaped container side wall of FIG. 5.

Figure 6:
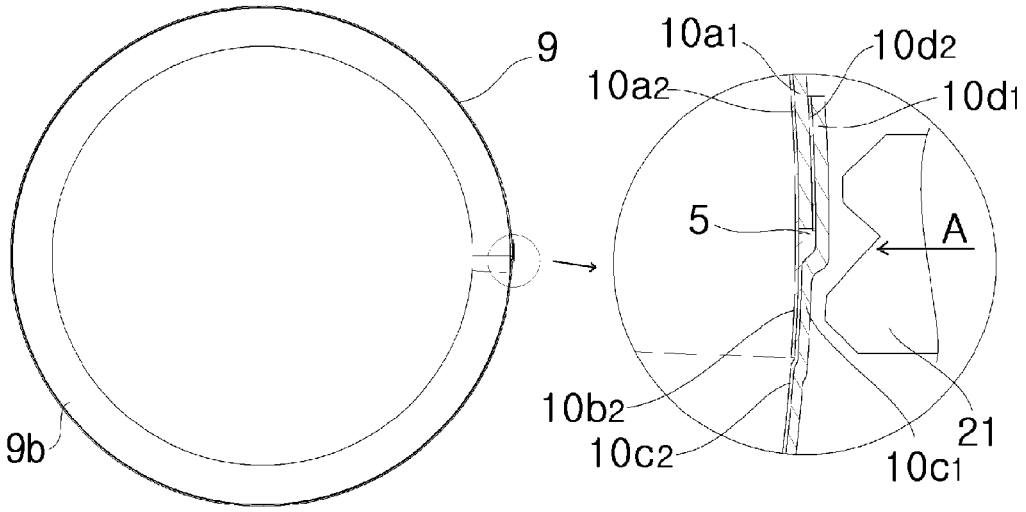
FIG. 6 is a partial enlarged view of a section of a cut portion of a fusion-bonded portion of the bonding surface of FIG. 5.
Figure 7:
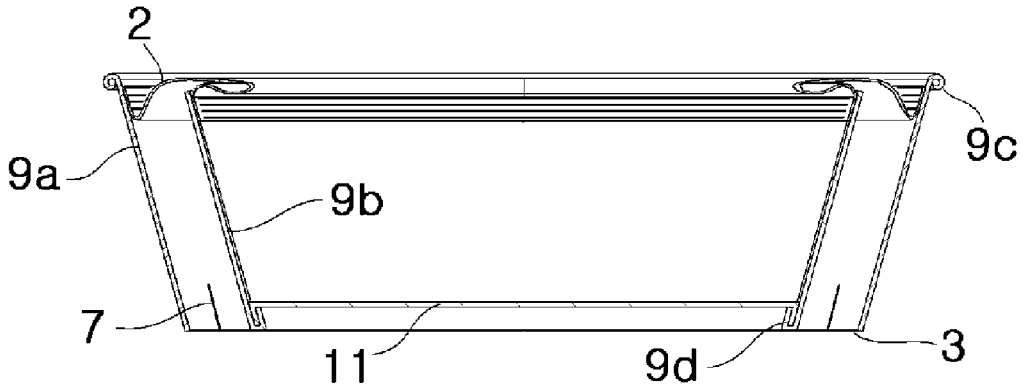
FIG. 7 is a cross-sectional view illustrating a folded state of a foldable paper cup in which a side paper and a bottom paper are coupled according to the present invention.
Figure 8:
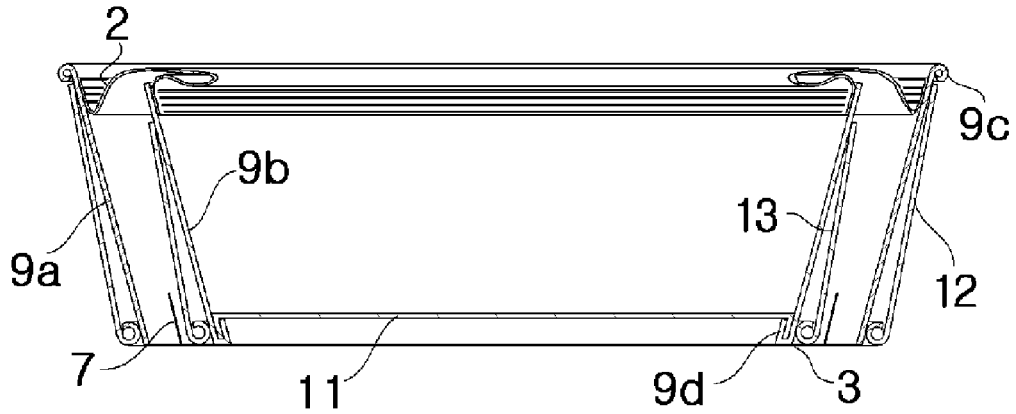
FIG. 8 is a cross-sectional view illustrating a state in which a paper cover is coated at a foldable paper cup in which a side paper and a bottom paper are coupled according to the present invention.

In the foldable container, when bonding a bonding surface in order to secure mobility, a film of mold-releasing portion should not be bonded with an original side paper. FIG. 6 illustrates a partially enlarged view of a mold-releasing portion taken in a radial direction, and an original paper 10*a*1 and a film 10*a*2 of the internal bonding surface are separated, and an original paper 10*c*1 and a film 10*c*2 of the external bonding surface are also separated. In a state in which another original paper 10*d*1 and film 10*d*2 of the external bonding surface are bonded, the internal bonding surface and the external bonding surface are overlapped. A film cutting part 5 cut by a half knife operation divides into a film of the external bonding surface to a portion 10*d*2 that bonds to an original paper and a portion 10*c*2 that separates from the original paper.

In a portion bonded by a supersonic wave, high frequency, or heater block, the film 10*b*2 of the internal bonding surface and the film 10*c*2 of the external bonding surface are one, and the original paper 10*a*1 of the internal bonding surface and the film 10*d*2 of the external bonding surface are the other one. At one of the former, bonding between two films should be surely performed, but the film should be controlled not to bond an original paper of the external bonding surface. Further, at the other one, a film of the external bonding surface should be surely bonded to the original paper of the internal bonding surface, but due to an influence occurring upon bonding, the original paper and the film of the internal bonding surface should be controlled not to bond.

In order to satisfy such a condition, one side is instantaneously heated and the opposite side is cooled so that a heat of one side has no influence on a film of the opposite side. Therefore, the film bonding portion 10*b*2 of the internal bonding surface and the original paper bonding portion 10*d*1 of the external bonding surface are bonded by installing a supersonic wave or heater block, and the film bonding portion 10*a*2 of the internal bonding surface and the original paper bonding portion 10*c*1 of the external bonding surface are bonded by installing a cooling device.

Terms or words used at this specification and claims should not be interpreted by limiting to a common or dictionary meaning, in order for an inventor to describe the invention with the best method, under a principle that may appropriately define a concept of the term, the term should be interpreted as a meaning and a concept that correspond to the spirit and scope of the present invention.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims.

INDUSTRIAL APPLICABILITY

Cup ramen container

The invention claimed is:

1. A method of shaping a side paper of a foldable paper cup that can fold by cutting an intermediate portion of a container side wall and that includes a container side wall that winds the side paper in a cone shape, a curling part that is circularly wound to the outside in an upper end portion of the side wall, and a bottom paper support shaping portion by coupling to enclose a downward bent portion by bending a lower end portion of the side wall to the inside in a state in which a bottom paper having a downward bent portion in which an entire circumference of an outer circumferential surface is bent downward is inserted into a lower end portion of the side paper, the method including:

first step of forming a cutting part that divides a portion of a continued original side paper into a side paper upper portion and lower portion;

second step of laminating a film and the original side paper and forming a mold-releasing portion in which the original side paper and the film are not bonded in the portion of the side paper upper portion;

third step of cutting one end film of the mold-releasing portion and separating a fan-shaped side paper from the original side paper; and fourth step of forming the cone-shaped container side wall by circularly winding and attaching the side paper to a shaping device.

2. The method of claim 1, wherein the first step comprises forming a side surface cutting part that cuts in a height direction of the container by connecting to one end of the cutting part.

3. The method of claim 1, wherein the first step comprises forming a plurality of cutting grooves that cut in a height direction of the container along the cutting part.

4. The method of claim 1, further comprising applying and drying a mold-releasing agent to the mold-releasing portion of the original side paper before or after the first step.

5. The method of claim 4, wherein the film of at the second step is a laminating film in which an adhesive is applied to an entire film.

6. The method of claim 4, wherein at the second step, the film or the original side paper is bonded by continuously applying an adhesive.

7. The method of claim 4, wherein a portion that applies the mold-releasing agent is an outer portion of a side surface cutting part and an entire upper portion of the side paper, except for an outer circumferential edge of an upper portion of the side paper.

8. The method of claim 4, wherein the mold-releasing agent is a film or a thin plate of a material different from UV coating, silicone coating, or a laminating film.

9. The method of claim 1, wherein at the second step, the film is a laminating film in which an adhesive is applied to an entire film, except for the mold-releasing portion.

10. The method of claim 9, further comprising applying and drying an mold-releasing agent before or after the first step to a portion pressed by a heater, high frequency, or supersonic wave block at the fourth step in the mold-releasing portion.

11. The method of claim 9, wherein a shaping mold of a shaping machine has the heater block at a portion at which a film bonding surface is positioned.

12. The method of claim 9, wherein the mold-releasing agent is a film or a thin plate of a material different from UV coating, silicone coating, or a laminating film.

13. The method of claim 1, wherein at the third step, a half knife work of cutting a film and an entire knife work of separating the side paper is simultaneously or sequentially performed in a process.

14. The method of claim 13, wherein the half knife work is a half knife work of a portion of a cutting part while cutting a film of one end of the mold-releasing portion.

15. The method of claim 1, wherein the shaping device of the fourth step comprises a shaping mold, rotation plates, and a pressing, supersonic wave, high frequency, or heater block.

16. The method of claim 15, wherein the shaping mold has a cooling device at a portion at which a bonding surface is positioned.

17. The method of claim 15, wherein the rotation plates operate internal bonding surfaces of the side paper to position at the inside further than external bonding surfaces.

* * * * *